US005709616A

United States Patent [19]

Rife

[11] Patent Number: 5,709,616

[45] Date of Patent: Jan. 20, 1998

[54] GROOVE CONFIGURATION FOR A PUTTER TYPE GOLF CLUB HEAD

[76] Inventor: Guerin D. Rife, 1310 S. Pennsylvania Ave., Winter Park, Fla. 32789

[21] Appl. No.: 655,827

[22] Filed: May 31, 1996

[51] Int. Cl.[6] ..... A63B 53/04

[52] U.S. Cl. ..... 473/330; 473/331

[58] Field of Search ..... 473/330, 331, 473/290, 236

[56] References Cited

U.S. PATENT DOCUMENTS

| | | | |
|---|---|---|---|
| 732,137 | 6/1903 | Taylor | 473/331 |
| 1,289,553 | 12/1918 | Sanders . | |
| 1,337,958 | 4/1920 | Reach | 473/331 |
| 1,532,545 | 4/1925 | Pedersen . | |
| 1,743,957 | 1/1930 | Carr | 473/331 |
| 4,413,825 | 11/1983 | Sasse | 473/331 |
| 4,461,482 | 7/1984 | Bojick | 473/331 |
| 4,529,203 | 7/1985 | Ribaudo | 473/331 |
| 4,858,929 | 8/1989 | Long | 473/331 |
| 4,964,641 | 10/1990 | Miesch | 473/330 |
| 5,029,864 | 7/1991 | Keener . | |
| 5,193,806 | 3/1993 | Burkly | 473/331 |

*Primary Examiner*—Sebastiano Passaniti
*Attorney, Agent, or Firm*—Aquilino & Welsh

[57] ABSTRACT

A putter type golf club having a series of V-shaped grooves positioned immediately adjacent each other forming outermost ball gripping edges which grip a golf ball when the ball is struck by the putter.

18 Claims, 2 Drawing Sheets

GROOVE CONFIGURATION FOR A PUTTER TYPE GOLF CLUB HEAD

BACKGROUND AND SUMMARY OF THE INVENTION

The present invention relates to putter type golf club heads and, in particular, to putters having an improved groove configuration on the ball striking face.

Most putters are provided with a smooth ball striking face without grooves. In my co-pending patent application, Ser. No. 08/601,861, filed Feb. 15, 1996, entitled Improved Groove Configuration for a Golf Club, which is incorporated herein by reference, the use of various groove configurations for putter type golf clubs was described.

Typically ,wood and iron type golf club heads are provided with grooves on the ball striking face to engage the ball and create spin for more consistent shot control. The majority of these types of clubs use U-shaped or V-shaped groove configurations which are spaced and have a flat surface between the grooves. Other groove configurations of interest are shown in U.S. Pat. No. 5,029,864 to Keener, which relates to a groove configuration for an iron type golf club head having V-shaped grooves including a normal and contact face to provide improved backspin. Another patent of interest is U.S. Pat. No. 1,289,553 to Sanders, which shows an iron type golf club head with a raised groove configuration triangular in cross section. Still another patent of interest is U.S. Pat. No. 1,532,545 to Peterson, which shows a curved ball striking face with a sawtooth groove configuration, as seen in FIG. 4.

The present invention relates to a putter type golf club head having an improved groove configuration formed longitudinally across the ball striking face in a heel to toe direction wherein each of the grooves are symmetrical, each with the other, and are triangular in cross section with the opposed sides of each V-groove being identical in length and angle. The grooves form a series of triangular grooves which are perpendicular to the ball striking face. The angle of each of the sides forming the groove may be shallow or deep, as long as the side angles are identical. The outer edges of the grooves may be pointed, slightly rounded, or flattened.

The groove configuration of the invention creates a gripping action on the ball and, as with the aforementioned co-pending application, eliminates the need for different putter face lofts, thereby making a single putter adaptable to any putting surface.

Among the objects of the present invention is the provision of a putter type golf club head having an improved groove configuration to impart more control to a golf ball when it is struck at a target.

Another object is the provision of a groove configuration on a putter type golf club head forming an outwardly projecting surface which grips the ball when it is struck.

Another object is the provision of a putter type groove configuration which eliminates the need for different lofted putters for different putting surfaces.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
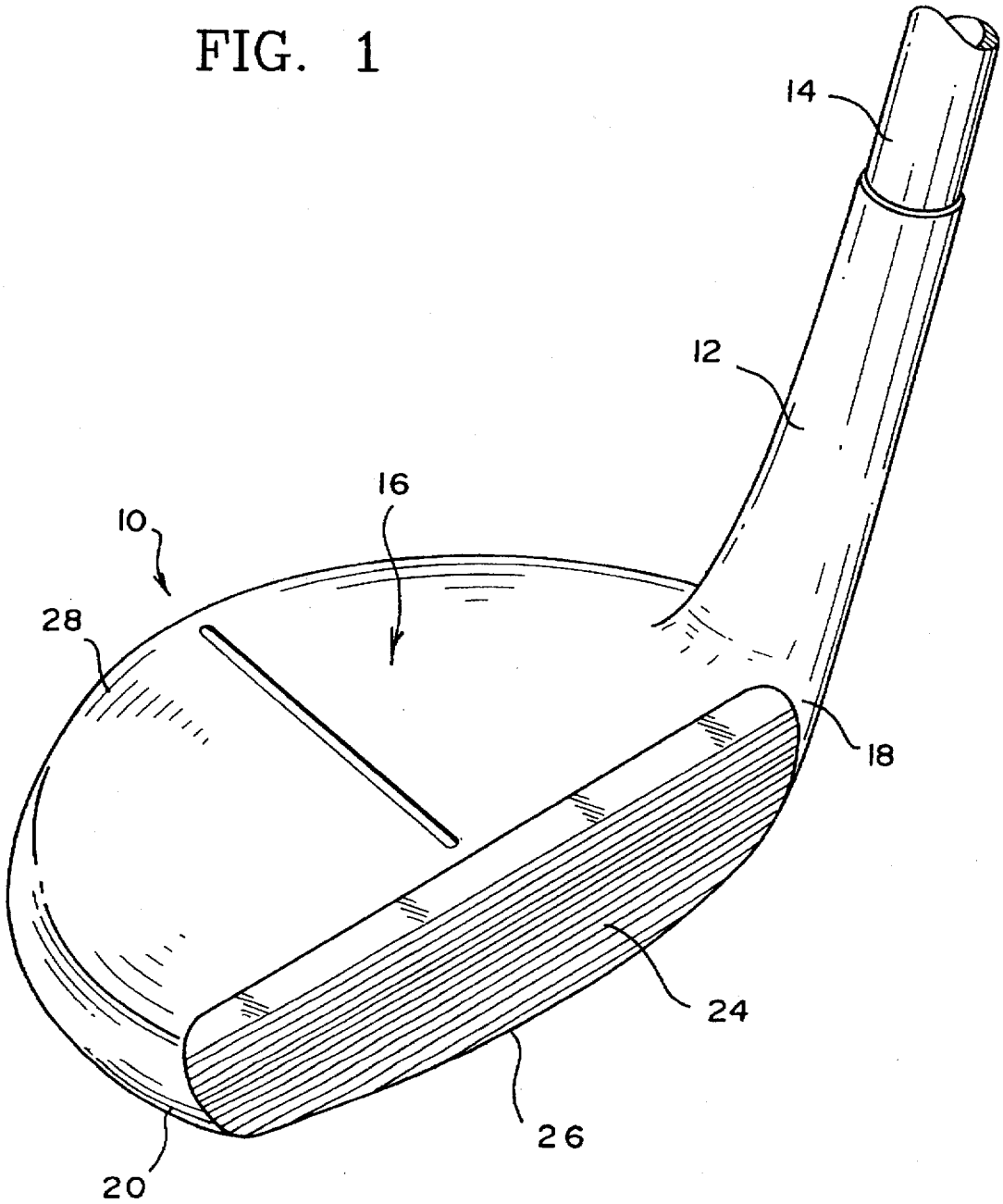
FIG. 1 shows a perspective view of a putter type golf club head having a groove configuration in accordance with the present invention.
Figure 2:
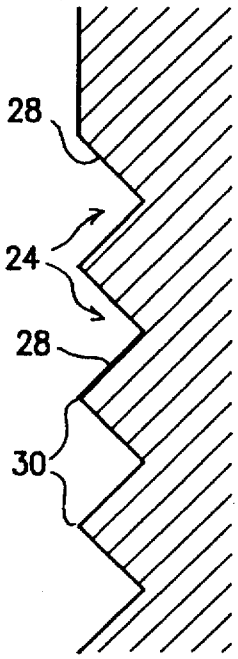
FIG. 2 is a partial sectional view taken along the lines 2—2 of FIG. 1 showing the groove configuration of the invention.

Referring to the drawings, FIGS. 1 and 2 show a putter type golf club head 10 including a hosel 12 and shaft 14, partially shown, and club head body 16. The club head body 16 is a conventional mallet head design and includes a heel 18, toe 20 and a planar ball striking face 22. A series of parallel grooves 24 are formed in the ball striking face 22 in a heel 18 to toe 20 direction. In the preferred embodiment shown, the grooves 24 extend all the way between the heel 18 and toe 20 and extend from a bottom leading edge 17 to a point just below a top surface 19 on the putter head 16. The grooves 24 are located immediately adjacent each other and have outermost gripping edges 30 which are common to adjoining grooves 24 and which form a ball striking surface substantially coplanar with the ball striking face. Each of the grooves 24 have a common size and configuration such that all the grooves are identical to the others.

Referring to the partial sectional view of FIG. 2, in this embodiment, each groove 24 is V-shaped and is formed with a pair of flat wall surfaces 28 disposed at an angle with respect to the planar ball striking face 22 and which wall surfaces 28 are of identical size and are mirror images of each other. Similarly, the wall surfaces 28 of adjoining grooves 24 are identical in size and angular orientation. The wall surfaces 28 form an angle of ninety degrees at the bottom 27 of the groove 24. Each wall surface 28 likewise is oriented at an angle of forty five degrees with a line perpendicular to the planar ball striking face 22. Thus, it can be seen that each groove is cut or otherwise formed in the ball striking face 22 in a saw-tooth configuration whereby each groove 24 is identical with the others.

It will be appreciated that whereas the groove configuration of the present invention is shown on a mallet type putter, it is equally applicable to a wide variety of putter shapes and sizes and that the grooves may extend greater or lesser distances in the heel to toe and bottom leading edge to the top surface directions, the only requirement being that the grooves be formed on the ball striking face 22 in the area where a golf ball would normally be struck with putter 10 when a golfer executes a putting stroke.

FIGS. 3 through 9 show various embodiments of groove configurations used on putter heads in accordance with the present invention. It will be appreciated that the features of putter heads not shown and using the various groove configurations in FIGS. 3 through 9 may be essentially the same as that described with respect to FIG. 1.

Figure 3:
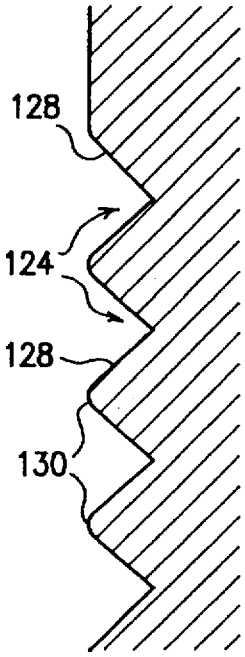
FIG. 3 is a partial sectional view of a second embodiment of a groove configuration in accordance with the present invention.

FIG. 3 illustrates an embodiment of a groove configuration including a plurality of parallel grooves 124 having wall surfaces 128 formed at a 90 degree angle with respect to each other as with the embodiment described hereinabove. In this embodiment, the outermost ball gripping edges 130 of the grooves 124 are rounded and form a less sharp gripping edge for engaging a golf ball.

Figure 4:
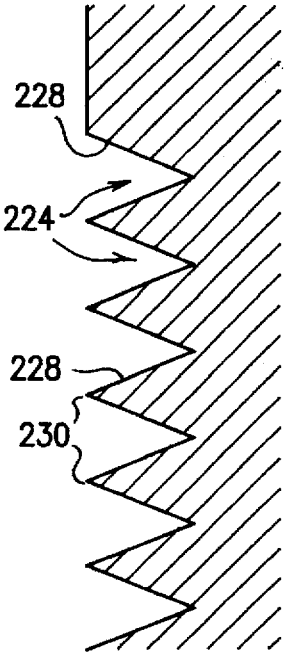
FIG. 4 is a partial sectional view of a third embodiment of a groove configuration in accordance with the present invention.

FIG. 4 illustrates a third embodiment of a groove configuration including a plurality of grooves 224 having wall surfaces 228 formed at a sharper angle, preferably 50 degrees with respect to each other. Outermost ball gripping edges 230 are also pointed, but at a sharper angle to engage a golf ball when struck by a putter made in accordance with the present invention.

Figure 5:
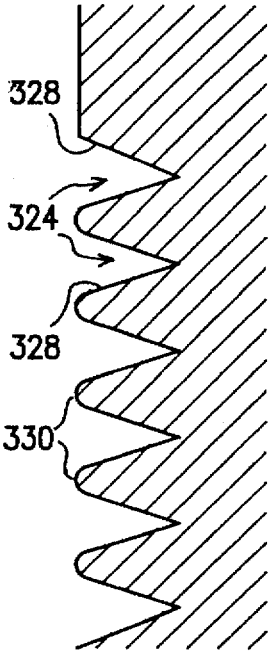
FIG. 5 is a partial sectional view of a fourth embodiment of a groove configuration in accordance with the present invention.

FIG. 5 shows a fourth embodiment of a groove configuration including a plurality of parallel grooves 324 having wall surfaces 328 disposed at an angle of 50 degrees and which include rounded outermost ball gripping edges 330.

Figure 6:
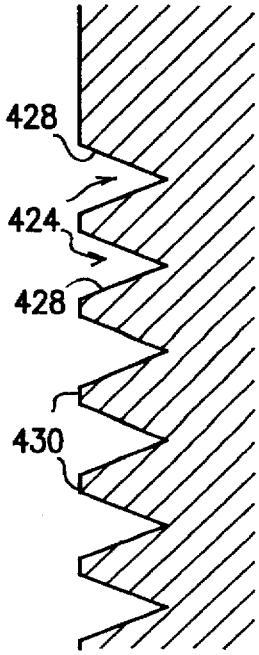
FIG. 6 is a partial sectional view of a fifth embodiment of a groove configuration in accordance with the present invention.

FIG. 6 illustrates a fifth embodiment of a groove configuration in accordance with the present invention including a series of grooves 424 having wall surfaces 428 disposed at an angle of at least 50 degrees with respect to each other and include a flat surface on outermost ball gripping edges 430. The flat surfaces 429 of the edges 430 are narrower than the full width of the groove 424.

Figure 7:
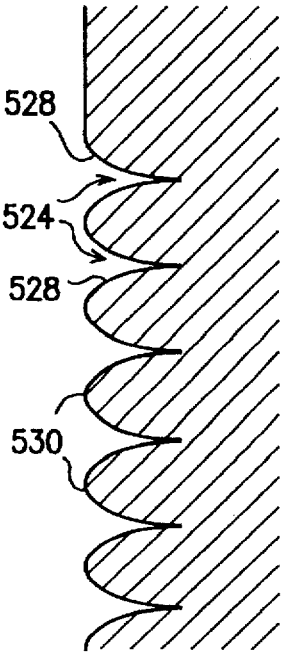
FIG. 7 is a partial sectional view of a sixth embodiment of a groove configuration in accordance with the present invention.

FIG. 7 illustrates a sixth embodiment of a groove configuration in accordance with the present invention including a series of grooves 524 having parabolic shaped wall surfaces 528 and rounded outermost ball gripping edges 530.

Figure 8:
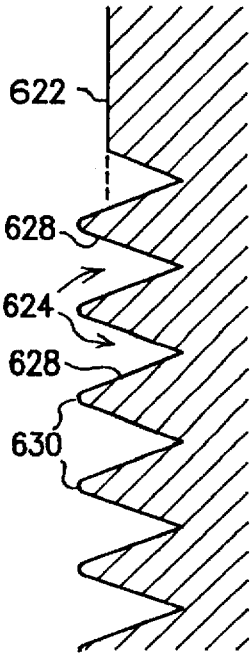
FIG. 8 is a partial sectional view of a seventh embodiment of a groove configuration in accordance with the present invention.

FIG. 8 illustrates a seventh embodiment of a groove configuration in accordance with the present invention including a series of grooves 624 which extend beyond the planar surface of the ball striking face 622. The grooves 624 have flat wall surfaces 628 and rounded outermost ball gripping edges 630.

Figure 9:
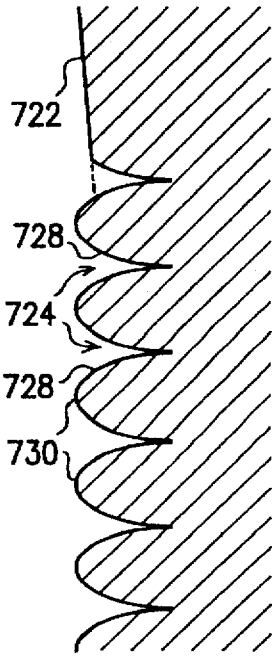
FIG. 9 is a partial sectional view of an eighth embodiment of a groove configuration in accordance with the present invention.

FIG. 9 illustrates an eighth embodiment of a groove configuration in accordance with the present invention including a series of grooves 724 which extend byond the planar ball striking face 722. The grooves have parabolic wall surfaces 728 terminating in rounded outermost ball gripping edges 730.

While various preferred embodiments have been shown and described, it will be understood that there is no intent to limit the invention by such disclosure. For example, the depth of the grooves may vary as well as the angle of the groove wall surfaces. Therefore, the patent is intended to cover all modifications and alternate constructions falling within the spirit and scope of the following claims.

I claim:

1. A putter type golf club head, including a club head body with a heel, toe, a planar ball striking face, upper surface and bottom surface, wherein the improvement comprises:

a series of grooves formed in said planar ball striking face, said grooves having a common size and configuration defining outermost ball gripping edges which form a ball striking surface on said planar ball striking face;

each of said grooves extending in a heel to toe direction; each of said grooves being positioned immediately adjacent another corresponding groove; said outermost ball gripping edges of a groove being common to immediately adjacent grooves on either side thereof; and said outermost ball gripping edges each having a width less than the width of a groove at the ball striking surface said grooves being further defined by a pair of groove wall surfaces being symmetrical to each other; said wall surfaces being identical in size and shape.

2. The putter type golf club head of claim 1, wherein said grooves are V-shaped and said outermost ball gripping edges form a point.

3. The putter type golf club head of claim 1, wherein said wall surfaces are disposed at an angle of at least fifty degrees with respect to each other.

4. The putter type golf club head of claim 1 wherein said grooves extend outwardly beyond said planar ball striking face.

5. The putter type golf club head of claim 1 wherein said wall surfaces are non-linear.

6. The putter type golf club head of claim 5 wherein said wall surfaces are parabolic in shape.

7. The putter type golf club head of claim 1 wherein said planar ball striking face has a loft angle of four degrees or less.

8. The putter type golf club head of claim 1 wherein said groove wall surfaces are flat and disposed at an angle less than 90 degrees with respect to said planar ball striking face.

9. The putter type golf club head of claim 1, wherein said wall surfaces are disposed at an angle of 90 degrees with respect to each other and at an angle of 45 degrees with respect to said planar ball striking face.

10. The putter type golf club head of claim 1 wherein said outermost ball gripping edges are rounded.

11. The putter type golf club head of claim 1 wherein said outermost ball gripping edges are flat.

12. A putter type golf club head, including a club head body with a heel, toe, planar ball striking face, upper surface and bottom surface, wherein the improvement comprises:

a series of V-shaped grooves formed in said planar ball striking face, said grooves having a common size and configuration including flat planar walls and outermost ball gripping edges which form a ball striking surface on said planar ball striking face;

each of said grooves extending in a heel to toe direction; each of said grooves being positioned immediately adjacent another corresponding groove; said outermost ball gripping edges of a groove being common to immediately adjacent grooves on either side thereof; said outermost ball gripping edges having a width less than the width of a single groove measured at the ball striking surface said grooves being further defined by a pair of groove wall surfaces being symmetrical to each other; said wall surfaces being identical in size and shape.

13. The putter type golf club head of claim 12 wherein said outermost ball gripping edges are rounded.

14. The putter type golf club head of claim 12 wherein said outermost ball gripping edges are flat.

15. The putter type golf club head of claim 14 wherein said flat outermost ball gripping edges are parallel to and coincident with said planar ball striking face.

16. The putter type golf club head of claim 12 wherein said width of said outermost ball gripping edges is further defined as being less than half of the width of a groove at the ball striking surface.

17. A putter type golf club head, including a club head body with a heel, toe, a planar ball striking face, upper surface and bottom surface, wherein the improvement comprises:

a series of grooves formed in said planar ball striking face, said grooves having a common size and configuration defining outermost ball gripping edges which form a ball striking surface substantially coplanar with said planar ball striking face;

each of said grooves extending in a heel to toe direction; each of said grooves being positioned immediately adjacent another corresponding groove; said outermost ball gripping edges of a groove being common to immediately adjacent grooves on either side thereof; and said outermost ball gripping edges each having a rounded surface and a width less than the width of a groove at the ball striking surface.

18. A putter type golf club head, including a club head body with a heel, toe, a planar ball striking face, upper surface and bottom surface, wherein the improvement comprises:

a series of grooves formed in said planar ball striking face, said grooves having a common size and configuration defining outermost ball gripping edges which form a ball striking surface substantially coplanar with said planar ball striking face;

each of said grooves extending in a heel to toe direction; each of said grooves being positioned immediately adjacent another corresponding groove; said outermost ball gripping edges of a groove being common to immediately adjacent grooves on either side thereof; and said outermost ball gripping edges each having a flat surface and a width less than the width of a groove at the ball striking surface.

* * * * *